United States Patent [19]

Wexler

[11] Patent Number: 4,795,398

[45] Date of Patent: Jan. 3, 1989

[54] FLOWER POT DOLL

[75] Inventor: Howard Wexler, New York, N.Y.

[73] Assignee: Cap Toys Inc., Solon, Ohio

[21] Appl. No.: 75,610

[22] Filed: Jul. 20, 1987

[51] Int. Cl.[4] ..... A63H 3/14; A63H 00/00

[52] U.S. Cl. ..... 446/327; 446/369; 446/310

[58] Field of Search ..... 446/327, 310, 311, 312, 446/309, 308, 328, 329, 330

[56] References Cited

U.S. PATENT DOCUMENTS

| | | | |
|---|---|---|---|
| 821,468 | 5/1906 | Dashiell | 446/310 |
| 978,489 | 12/1910 | Salmond | 446/310 |
| 2,655,762 | 10/1953 | Burke | 446/327 |
| 2,701,934 | 2/1955 | Auzin | 446/310 X |
| 3,667,155 | 6/1972 | Freelander | 446/310 |
| 3,763,591 | 10/1973 | Fontana | 446/310 X |
| 4,601,670 | 7/1986 | Williams | 446/327 |

FOREIGN PATENT DOCUMENTS

| | | | |
|---|---|---|---|
| 371130 | 3/1923 | Fed. Rep. of Germany | 446/327 |
| 19692 | of 1893 | United Kingdom | 446/310 |
| 141307 | 4/1920 | United Kingdom | 446/310 |

*Primary Examiner*—Robert A. Hafer
*Assistant Examiner*—D. Neal Muir
*Attorney, Agent, or Firm*—Wood, Herron & Evans

[57] ABSTRACT

A doll and flower-in-pot combination. A head is pivotally attached to a hollow body and the hollow body is attached to a sleeve. When the sleeve is folded by upon the body and the head folded down, the combination appears to be a flower pot. Raising the head or pulling the sleeve down, or both, produces a doll.

20 Claims, 2 Drawing Sheets

FLOWER POT DOLL

BACKGROUND OF THE INVENTION

This invention relates to a convertible toy, and more particularly, the invention relates to a flower in a pot that is convertible to a doll.

SUMMARY OF THE INVENTION

A doll is formed with a doll head pivoted to a hollow body, the hollow body being connected to a sleeve. The head is divided into front and back by a brim that resembles a hat brim. The back of the doll's head is decorated with flowers. The front of the head has a face and hair that projects from under the brim.

When the sleeve is folded up around the body and the head is folded forward with the face disposed within the sleeve, only the brim and flower are visible above the rim of the sleeve and thus the toy appears to be simply a flower in a pot.

When the head is pivoted upwardly, it appears as a doll peering from the rim of the flower pot, the doll wearing a hat formed by the brim and flowers.

When the sleeve is pulled downwardly to expose the body of the doll, the doll appears to be complete with a body, arms, and legs, the body being clothed with a dress.

When the sleeve is tucked inside the hollow body, the toy appears to be a simple doll that will sit up on a base formed by the joint between the body and the sleeve.

Preferably, the head and two arms are hollow so that the user's arm and hand can be inserted through the sleeve and hollow body with fingers projecting into the head and hollow arms, thereby enabling the user to hold the doll with one hand and arm while manipulating the head and doll arms. The user uses its free hand to pull the sleeve to effect the conversion through four basic stages from a flower pot to a full doll.

BRIEF DESCRIPTION OF THE DRAWINGS

The flower pot doll is indicated at 10 in the drawings. As shown in FIG. 1, it appears only as a flower in a pot. In FIGS. 4 and 5, the sleeve portion that forms the pot has been folded down, thereby exposing the full doll.

Figure 4:
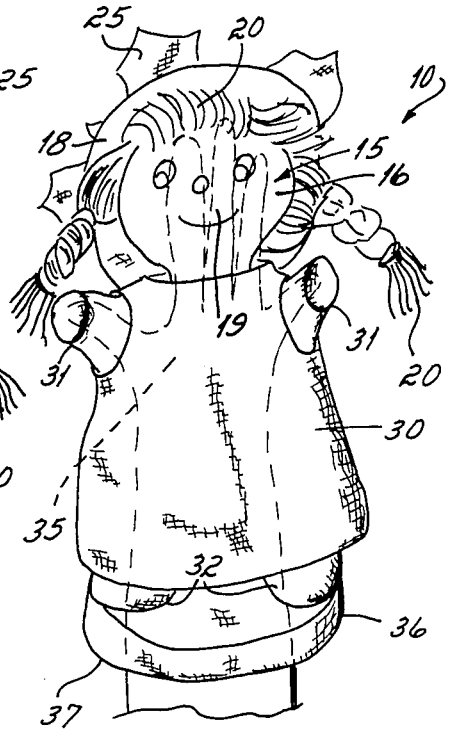
FIG. 4 is a front perspective view of the entire doll with the sleeve pulled all the way down.
Figure 5:
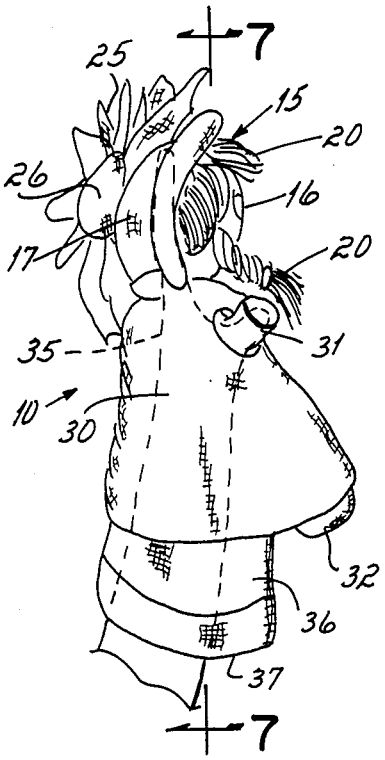
FIG. 5 is a side view similar to FIG. 4.
Figure 7:
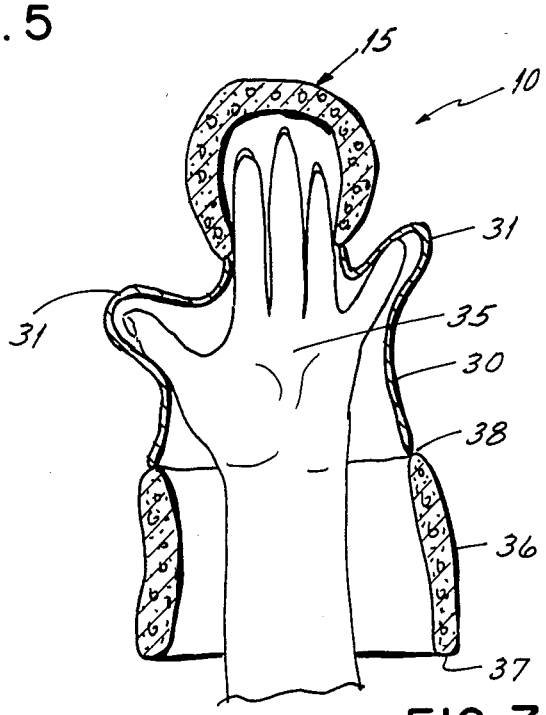
FIG. 7 is a diagrammatic cross-sectional view taken along lines 7—7 of FIG. 5.

The description begins with reference to FIGS. 4, 5 and the cross-sectional view of FIG. 7. The doll is formed preferably of a washable cottonlike fabric that is padded to give the elements of the doll body a sufficient stiffness for the intended uses, as will be described. The doll has a head 15 that is divided into a front face 16 and a back of the head 17 by a brim 18. A face 19 is painted on the front of the head, and yarn 20 projects from the brim 18 to simulate doll hair. The back of the head is decorated, preferably with leaves 25 and a flower in bloom 26. The head is pivotally stitched to a hollow body 30 that is slightly padded. At the joint between the head and the body, hollow arms 31 are formed and enter into the body. The head is hollow so that a hand indicated at 35 projecting into the body can project fingers into the head and into the arms so as to manipulate the head and arms to provide animation to the doll. A padded sleeve 36 is stitched to the body. Legs 32 are attached to the juncture 38 between the sleeve 36 and body 30.

Figure 1:
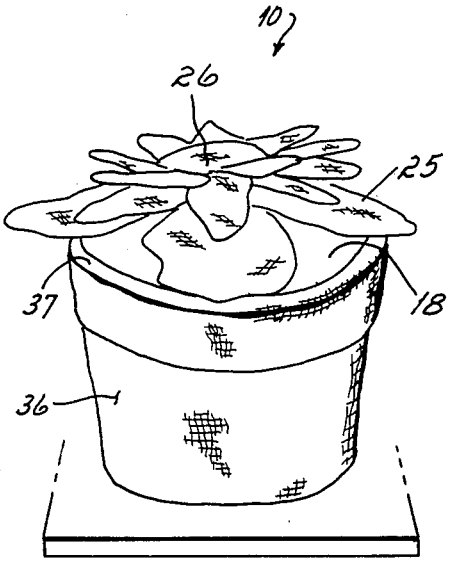
FIG. 1 is a perspective view of a flower and pot without any hands showing.
Figure 2:
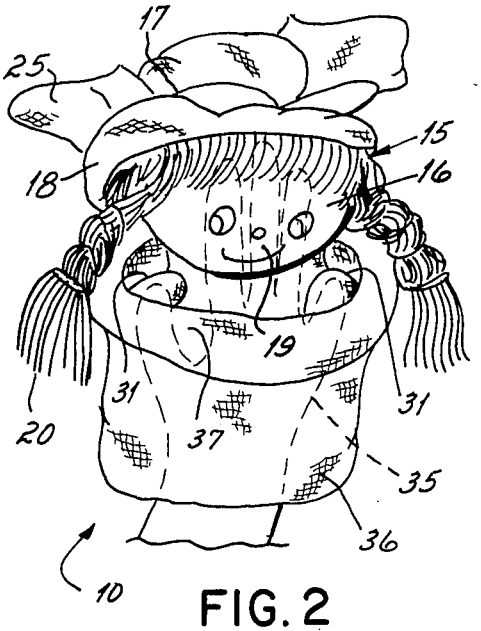
FIG. 2 is a front perspective view of the pot with head and hands visible.
Figure 3:
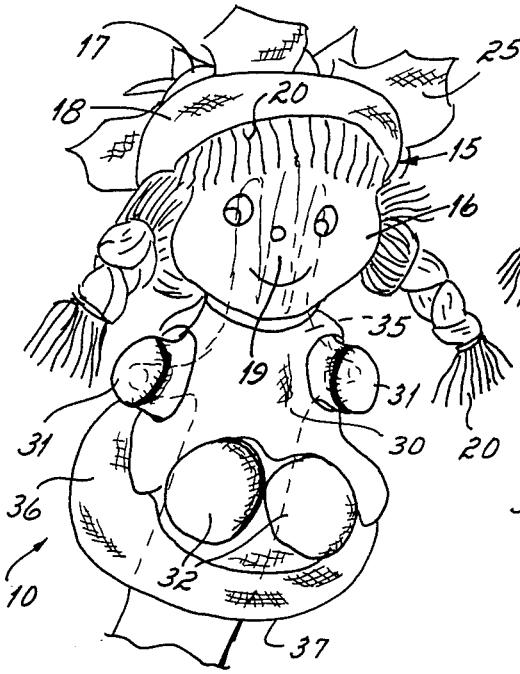
FIG. 3 is a front perspective view of the entire doll.

In the operation of the invention, the sleeve 36 is folded upwardly with respect to the body 30 and the head 15 is folded into the sleeve with the brim 18 engaging the upper rim portion 37 of the sleeve 36, thereby concealing the face and hair within the sleeve. In that attitude, the doll appears to be simply a flower in a pot. The head and arms can be reached by a hand extending upwardly through the body 30 and into the hollow head 15 and arms 31. With the hand thus in place, the fingers can pop the head and arms out of the sleeve 36, thus instantaneously changing the flower-in-pot to a doll peeping over the rim of the flower pot. See FIG. 2.

Further upward thrusting of the hand with respect to the sleeve 36 causes the sleeve to fold down and expose the legs 32. In this attitude, the user can manipulate the head and arms just as a puppeteer would do with the arm being concealed by the sleeve 36. See FIGS. 3, 4, 5 and 7.

Figure 6:
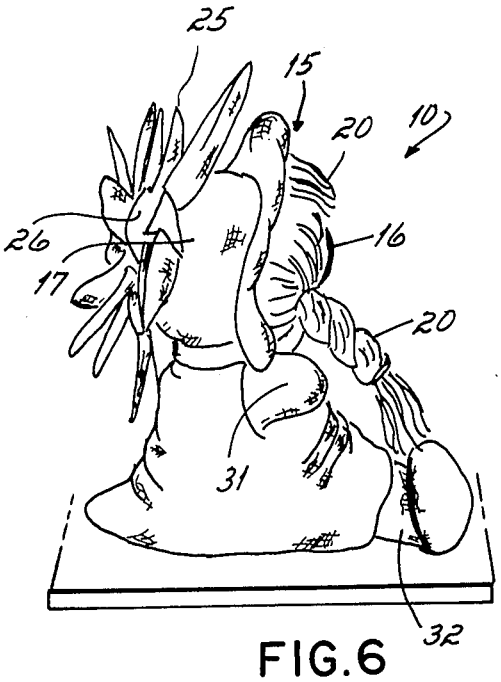
FIG. 6 is a side view of the doll in a seated position with the sleeve tucked inside the body.

Finally, with the sleeve 36 tucked into the hollow body 30 (FIG. 6), the toy appears to be simply a doll which can be seated on a base formed by the joint 38 between the body 30 and the sleeve 36.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof.

I claim:

1. A hand puppet comprising:

a hollow doll head having front and back portions, a doll face being formed on the front portion of said doll head;

a hollow body attached to said hollow doll head; and a hollow, flexible padded sleeve attached to said hollow doll body, said sleeve being rollable upwardly with respect to said hollow doll head to receive said hollow doll body and the front portion of said hollow doll head to conceal said hollow doll body and the front portion of said hollow doll head therein, said sleeve being rollable downwardly with respect to said doll head to expose first the doll face and then said doll body and to conceal a substantial portion of an user's arm when the user's hand is inserted through said unrolled sleeve and into said doll's hollow body and head.

2. A hand puppet as in claim 1 further comprising:

hollow doll arms attached to and opening into said hollow doll body; and said hollow doll head opening into said hollow doll body, whereby fingers of the user's hand can be inserted into the hollow doll head to move it, and the thumb and little finger of the hand can be inserted into said hollow doll arms to waggle them.

3. A hand puppet as in claim 2 further comprising:

doll legs attached adjacent the juncture between said hollow doll body and said sleeve to simulate a complete hand puppet when said sleeve is unfolded with respect to said hollow doll body.

4. A hand puppet as in claim 1 wherein said sleeve can be tucked into said hollow doll body to simulate a base permitting the hand puppet to sit up on the base.

5. A hand puppet as in claim 1 further comprising:

a ring-like brim positioned about said hollow doll head and dividing said hollow doll head into front and back portions; and doll hair projecting below said brim;

said brim having an outside diameter about the same size as the inside diameter of said sleeve so that when said sleeve is rolled completely upwardly said brim engages said rolled sleeve and conceals said doll hair within said rolled sleeve when said doll face and doll body are received in said rolled sleeve.

6. A hand puppet as in claim 1 wherein said sleeve is of two plies containing padding between plies to provide body thereto.

7. A toy having a flower-in-pot configuration and a toy doll configuration comprising:

a doll head, said doll head having a brim dividing said doll head into front and back surfaces, said front surface being configurated as a doll face, said back surface having decorative means thereon which may simulate a flower or a doll hat depending upon in which configuration the toy is positioned;

a doll body attached to said doll head;

a hollow, foldable sleeve attached to said doll body and being movable between folded and unfolded positions, said doll head being rotatable downwardly with respect to said doll body into said sleeve when said sleeve is completely folded upwardly to expose said decorative means and the back surface of said doll head with said brim engaging said upwardly folded sleeve to conceal the doll face and said doll body thereby presenting a first configuration simulating a flower-in-pot wherein said decorative means simulates said flower, and said head being rotatable upwardly with respect to said doll body to pop it out of said upwardly-folded sleeve to expose said doll face and said doll body and thereby presenting a second configuration, namely, a toy doll wherein said decorative means simulates said doll hat.

8. A toy as in claim 7 further comprising doll arms attached to said doll body.

9. A toy as in claim 8 further comprising doll legs attached adjacent that juncture defined between said doll body and said sleeve to simulate a complete toy doll.

10. A toy as in claim 7 further comprising doll hair projecting below said brim so that when said brim engages said upwardly folded sleeve said brim cooperates with said sleeve and conceals said doll hair received within said sleeve.

11. A toy as in claim 8 wherein said doll head, doll arms and doll body are hollow, said hollow doll head being rotatably attached to and opening into said hollow doll body and said hollow doll arms opening into said hollow doll body so that when a hand of a user is inserted through said sleeve the user can position his fingers into said hollow doll head to move said hollow doll head and his little finger and thumb into said hollow doll arms to move said arms.

12. A toy having multiple configurations comprising:

a doll body;

a doll head having front and back portions wherein the front portion includes a doll face formed thereon, said doll head being attached to said doll body;

a ring-like brim having an outside diameter attached to said doll head for dividing said doll head into the front and back portion;

a decorative configuration which may simulate a flower or a doll hat mounted on the back portion of said doll head depending upon in which configuration the toy is positioned; and a rollable sleeve attached to said doll body and being rollable between rolled and unrolled configurations, said rollable sleeve being formed with a hollow interior having an inside diameter about the same size as the outside diameter of said ring-like brim wherein when said rollable sleeve is rolled fully upwardly toward said doll head in the rolled configuration, said completely upwardly rolled sleeve receives within the hollow interior said doll body and the face portion of said doll head with the edge of said ring-like brim contacting said sleeve and thereby concealing said doll body and the face portion of said doll head thereby presenting a first configuration which may simulate a flower-in-pot and said decorative configuration may simulate the flower, and when said completely upwardly rolled sleeve is rolled partially downwardly away from said brim or said doll head is moved partially upwardly away from said completely upwardly rolled sleeve, the face portion of said doll head is exposed thereby presenting a second configuration which may simulate the face of a doll peeping over the edge of a flower pot, and when said rollable sleeve is rolled completely downwardly away from said doll head in the unrolled configuration, said doll body and the face portion of said doll head are exposed presenting a third configuration which, namely, represents a toy doll wherein said decorative configuration may simulate a doll hat on the toy doll.

13. A toy as in claim 12 wherein said rollable sleeve is of flexible, two plies containing padding therebetween to provide flexible, body thereto.

14. A toy as in claim 12 further comprising:

doll legs attached adjacent to the juncture between said doll body and said rollable sleeve to present a complete toy doll configuration when said rollable sleeve is in the completely unrolled configuration.

15. A toy as in claim 12 wherein said doll body is hollow and said rollable sleeve can be rolled into said hollow doll body from the unrolled configuration to simulate a configuration of a toy doll sitting up on a base.

16. A toy as in claim 12 further comprising:

hollow arms attached to said doll body, said doll body being hollow and opening into said hollow arms, said doll head being hollow and opening into said hollow doll body, whereby fingers and thumb of a hand can be inserted through said rollable sleeve and said hollow doll body into said hollow doll head to move it, and the thumb and little fingers can be inserted into said hollow arms to waggle them.

17. A toy as in claim 12 further comprising:

doll hair projecting below said ring-like brim so that it conceals said doll hair within the hollow interior of said rollable sleeve when said rollable sleeve is in the rolled configuration.

18. A toy as in claim 12 wherein said rollable sleeve conceals a substantial portion of an arm of a person who has positioned his fingers and thumb into said hollow doll head, doll body and doll arms, respectively, when said rollable sleeve is in the unrolled configuration.

19. A soft sculptured toy interchangeable between first and second toy configurations, the first and second toy configurations having decorative appearances which are separate and distinct from one another, said soft sculptured toy comprising:

a doll head having front and back portions, the front portion having a doll face formed thereon;

concealing means located on said doll head divides said doll head into the front and back portions;

decorative means located on the back portion of said doll head;

a doll body connected to said doll head; and a hollow, foldable sleeve connected to said doll body for receiving said doll body and the front portion of said doll head, said sleeve being movable between a folded position thereby presenting the first toy configuration and an unfolded position thereby presenting the second toy configuration whereby, when said sleeve is folded upwardly toward said doll head in the completely folded position, said concealing means engages said upwardly folded sleeve and conceals the face of said doll head and said doll body received within said sleeve and said exposed decorative means constitutes an integral decorative part of the decorative appearance of the first toy configuration, and when said sleeve is unfolded downwardly away from said doll head in the completely unfolded position, the face of said doll head and said doll body are exposed and said exposed decorative means constitutes an integral decorative part of the decorative appearance of the second toy configuration which, namely, in a toy doll.

20. A toy interchangeable between first and second toy configurations, the first and second toy configurations having decorative appearances which are separate and distinct from one another, said interchangeable toy comprising:

a doll head having front and back portions, the front portion having a doll face formed thereon;

concealing means located on said doll head divides said doll head into the front and back portions;

decorative means located on the back portion of said doll head;

a doll body connected to said doll head; and a receptacle for receiving said doll body and the front portion of said doll head, said receptacle being interchangeable between a closed position thereby presenting the first toy configuration and an opened position thereby presenting the second toy configuration whereby, when said receptacle is in the closed position, said concealing means engages said receptacle and conceals the face of said doll head and said doll body received within said receptacle and said exposed decorative means constitutes an integral decorative part of the decorative appearance of the first toy configuration, and when said receptacle is in the opened position, the face of said doll head and said doll body are exposed and said exposed decorative means constitutes an integral decorative part of the decorative appearance of the second toy configuration which, namely, is a toy doll.

* * * * *